United States Patent [19]

Deutsch

[11] 4,116,103

[45] Sep. 26, 1978

[54] PULSE WIDTH MODULATION IN A DIGITAL TONE SYNTHESIZER

[75] Inventor: Ralph Deutsch, Sherman Oaks, Calif.

[73] Assignee: Deutsch Research Laboratories, Ltd., Sherman Oaks, Calif.

[21] Appl. No.: 704,244

[22] Filed: Jul. 12, 1976

[51] Int. Cl.[2] ..... G10H 1/02; G10H 5/00

[52] U.S. Cl. ..... 84/1.24; 364/419; 364/718; 364/726

[58] Field of Search ..... 84/1.01, 1.24, , 1.25, 84/DIG. 4, DIG. 5; 364/419, 718, 726

[56] References Cited

U.S. PATENT DOCUMENTS

| | | | |
|---|---|---|---|
| 3,809,786 | 5/1974 | Deutsch | 84/1.01 |
| 3,809,792 | 5/1974 | Deutsch | 84/1.24 |
| 3,884,108 | 5/1975 | Deutsch | 84/1.24 |
| 3,972,259 | 8/1976 | Deutsch | 84/1.24 |

*Primary Examiner*—Stanley J. Witkowski

[57] ABSTRACT

In a digital tone synthesizer, musical tones are created by evaluating a generalized Fourier transform of harmonic coefficients. Tones corresponding to pulse-like waveshapes are simulated by using harmonic coefficient values associated with a pulse waveshape of specified shape. Apparatus is disclosed for producing sets of such harmonic coefficient values wherein each particular set is associated with a selected value of a pulse width parameter. Pulse width modulation tonal effects are achieved by changing the value of the pulse width parameter as a function of time. Means are described for including pulse width modulation as a subsystem of digital tone generators.

10 Claims, 9 Drawing Figures

PULSE WIDTH MODULATION IN A DIGITAL TONE SYNTHESIZER

BACKGROUND OF THE INVENTION

1. Field of the Invention

The present invention relates to the production of pulse width modulation effects in a digital tone synthesizer.

2. Description of the Prior Art

The inventor's Computor Organ described in U.S. Pat. No. 3,809,786 produces musical notes by computing the amplitudes at successive points of a complex waveshape and converting these amplitudes to notes as the computations are carried out. A discrete Fourier algorithm is implemented to compute each amplitude from a stored set of harmonic coefficients $c_q$ and a selected frequency number R, generally a non-integer, establishing the waveshape period. The computations, preferably digital, occur at regular time intervals $t$ independent of the waveshape period. At each interval $t$ the number R is added to the contents of a harmonic interval adder to specify the waveshape sample point $g$R, where $g=1,2,3, \ldots$. For each point $g$R, W individual harmonic component values $c_q \sin(\pi q g R/W)$ are calculated, where $q=1,2,3, \ldots, W$. These values are algebraically summed to obtain the instantaneous waveshape amplitude, which is supplied to a digital-to-analog convertor and a sound system for reproduction of the generated musical note. In a polyphonic musical instrument system, time sharing and multiplexing is used to calculate separately the sample amplitudes for each selected note, these amplitudes being combined by summation to produce the desired ensemble of a musical sound.

Deutsch et al in patent application Ser. No. 603,776, filed Aug. 11, 1975, and commonly assigned with this application describes a Polyphonic Tone Synthesizer wherein a computation cycle and data transfer cycle are repetitively and independently implemented to provide data which is converted to musical notes. During the computation cycle a master data set is created by implementing a discrete generalized Fourier algorithm using a stored set of harmonic coefficients which characterize the basic musical tone. The computations are carried out at a fast rate which is usually nonsynchronous with any musical frequency. Preferably, the harmonic coefficients and the orthogonal functions are stored in digital form, and the computations are carried out digitally. At the end of the computation cycle a master data set has been created and is temporarily stored in a data register.

Following a computation cycle, a transfer cycle is initiated which transfers the master data set to a multiplicity of read-write memories. The transfer for each memory is initiated by detection of a synchronizing bit and is timed by a clock which may be asynchronous with the main system clock and has a frequency P$f$, where $f$ is the frequency of a particular note assigned to a memory and P is two times the maximum number of harmonics in the musical waveshape. The transfer cycle is completed when all the memories have been loaded, at which time a new computation cycle is initiated. Tone generation continues uninterrupted during computation and transfer cycles.

While digital tone generators of the kind described above operate by implementing a Fourier-type transformation from the frequency domain to the time domain, analog tone generators generally operate only in the time domain. For example, analog tone synthesizers are designed to produce a rectangular-like pulse train in which the pulse repetition rate establishes the fundamental frequency $f$ of the produced note, and wherein the pulse shape and duty cycle determine the frequency spectral content of the tone.

To simulate pulse-type tone generation in a tone generator of the Computor Organ type described above, Deutsch in patent application Ser. No. 509,705, filed Sept. 26, 1974, and now U.S. Pat. No. 3,972,259 describes a means whereby harmonic coefficients are selected to correspond to the frequency transform of the pulse shape being simulated. Pulse-width modulation effects are achieved by storing a set of harmonic coefficients corresponding to a rectangular pulse-shape. The set of such coefficients is extended to an order $m$ greater than the maximum number W of Fourier components used in the waveshape amplitude computation. A selected subset of the stored coefficients then is employed to establish relative amplitudes of the Fourier components used in the computation. Pulse width modulation tonal effects are achieved by varying this subset as a function of time. Amplitude scaling may be used to compensate for amplitude envelope changes resulting from utilization of different harmonic coefficient subsets. The same system is equally applicable to the Polyphonic Tone Synthesizer described previously.

An object of the present invention is to simulate pulse-type tone generation, both with and without pulse width modulation effects, in a tone synthesizer employing a Fourier-type transformation from harmonic coefficients to the time domain. Another object of the present invention is to implement modulation of the harmonic coefficients used to establish the pulse-like musical tonal characteristics.

SUMMARY OF THE INVENTION

These and other objectives are achieved by providing a harmonic coefficient generating system wherein a set of harmonic coefficients corresponding to the spectral components of a rectangular pulse waveshape are generated during a coefficient computation cycle. During the coefficient computation cycle a discrete generalized Fourier transform algorithm is implemented such that each harmonic coefficient in the set is evaluated as a sum of component terms. Provision is made for introducing a pulse width parameter N. The value of N is compared to the number of component terms summed and is used to terminate the summation. The termination at a specified number of terms is equivalent to a specified pulse width of a rectangular train of pulses.

Provision is made for combining the harmonic coefficient generating system with tone generators of the Computor Organ and Polyphonic Tone Synthesizer types previously described. An alternative harmonic coefficient generation method is described wherein sets of harmonic coefficients corresponding to a rectangular pulse are created directly without summing a set of component terms.

BRIEF DESCRIPTION OF THE DRAWINGS

A detailed description of the invention will be made with reference to the accompanying drawings wherein like numerals designate like components in the several figures.

DESCRIPTION OF THE PREFERRED EMBODIMENT

The following detailed description is of the best presently contemplated modes of carrying out the invention. This description is not to be taken in a limiting sense, but is merely for the purpose of illustrating the general principles of the invention since the scope of the invention is best defined by the appended claims. Structural and operational characteristics attributed to forms of the invention first described shall also be attributed to forms later described, unless such characteristics are obviously inapplicable or unless specific exception is made.

Figure 1:
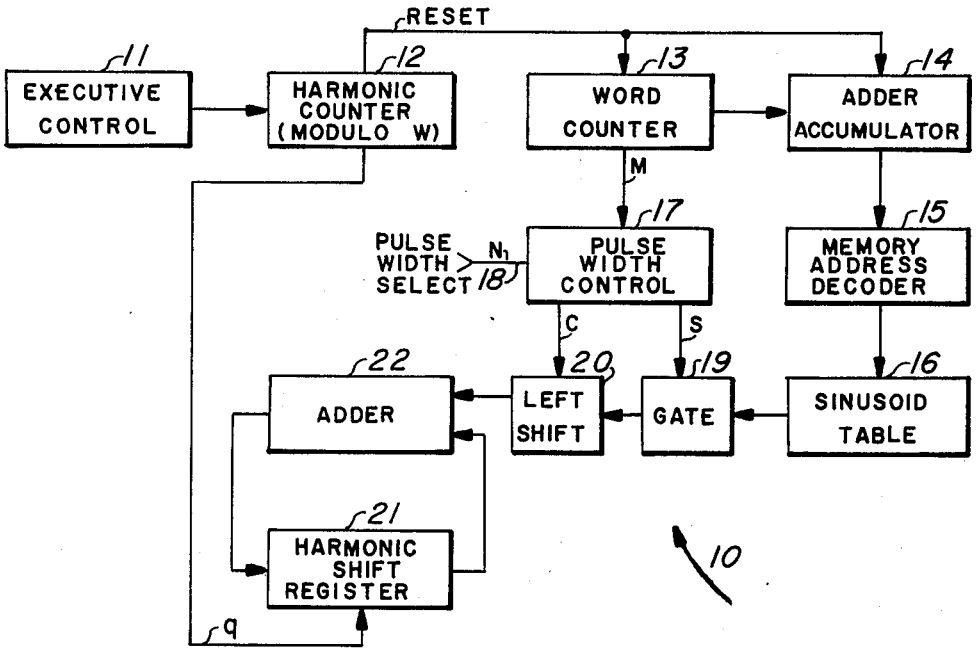
FIG. 1 is a block diagram of circuitry for implementing harmonic coefficients corresponding to pulse width modulation effects.

System 10 of FIG. 1 operates in a manner such that during a coefficient computation cycle a set of Fourier harmonic coefficients $d_q$ are evaluated according to the relation $$d_q = \sum_{M=0}^{N} h(M) \cos(2\pi qM/2W). \qquad \text{(Equation 1)}$$

$q$ is the harmonic number and takes on the sequence of values $q=1,2,3,\ldots,W$. W is the total number of Fourier harmonic coefficients. Advantageously W is selected as W=32. This value being adequate for tone synthesizers used to create bright tones for modern popular musical sounds. N is an integer number selected in the range of 0 to 2W. D=N/2W is a number that is used to designate the ratio of the width of rectangular pulse to the period of the repetition of the pulse. $h(M)$ is a function that has the value 1 for M=0 and has the value 2 for all other values of M.

Figure 2A:
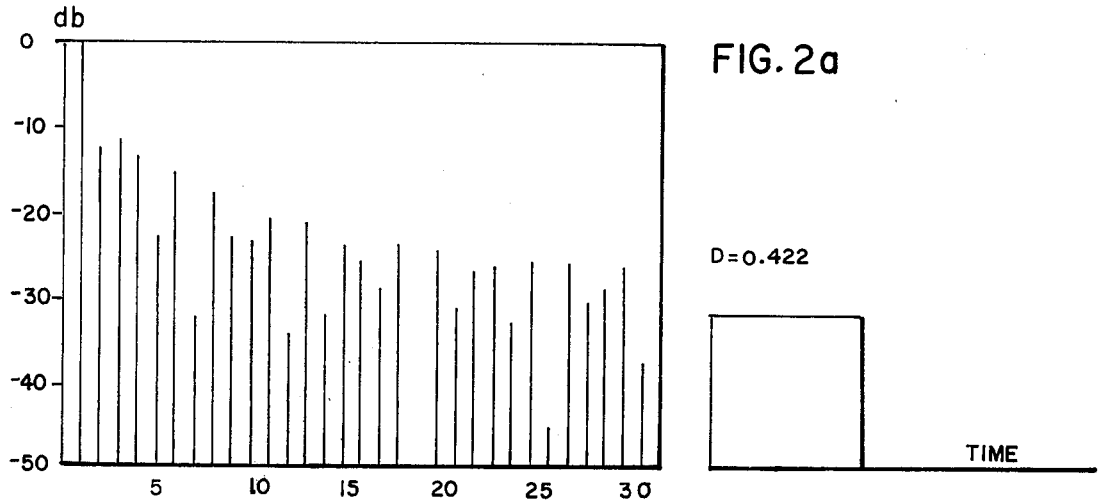
FIG. 2*a* is a graph of the harmonic coefficients expressed in db, for a rectangular pulse with duty factor 0.42.
Figure 2B:
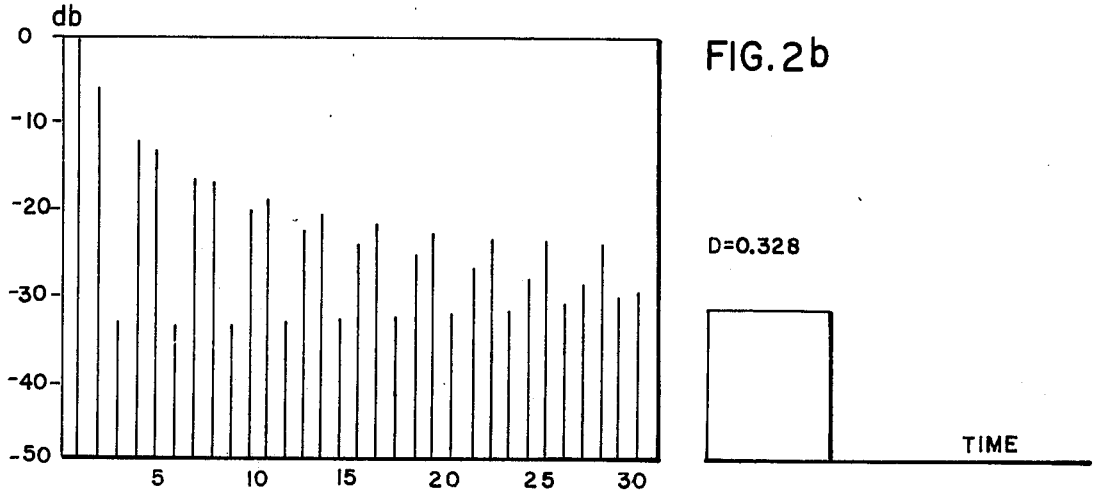
FIG. 2*b* is a graph of the harmonic coefficients expressed in db, for a rectangular pulse with duty factor 0.33.
Figure 2C:
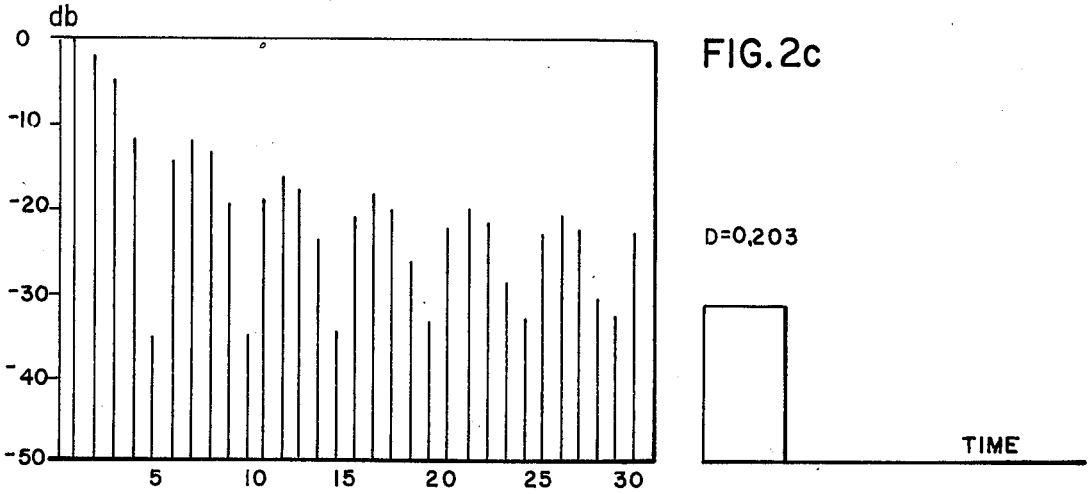
FIG. 2*c* is a graph of the harmonic coefficients, expressed in db, for a rectangular pulse with duty factor 0.20.

FIGS. 2*a*, 2*b*, and 2*c* illustrate the values of $d_q$ computed according to Eq. 1 and expressed in db. The db values of the harmonic coefficients are given by the relation $$\text{db} = 20 \log_{10}(d_q/d_1)$$

where $d_1$ is the value used to normalize the db values. The values shown in FIG. 2*a* are for D=0.422. The curve on the right side shows the time function and the curve on the left side shows the db values as a function of the harmonic number $q$. FIG. 2*b* is drawn for D=0.328 and FIG. 2*c* is drawn for D=0.203.

Executive Control 11 shown in FIG. 1 supplies all the timing control signals for System 10. For simplicity in illustration, only one such timing signal control line is explicitly drawn in the figure. At the start of a coefficient calculation cycle, Executive Control 11 initializes System 10 by setting the contents of Harmonic Counter 12 and Word Counter 13 to the value 1 and by setting the contents of Adder Accumulator 14 to value 0.

At the first bit time $t_1$ of the coefficient evaluation cycle, Executive Control 11 sets the contents of Harmonic Counter 12 to the value 1. Word Counter 13 was initialized to the value M=1 and retains this value as a constant during the first 32 bit times of the coefficient evaluation cycle. At time $t_1$, Adder Accumulator 14 receives the value M=1 from the contents of Word Counter 13. Memory Address Decoder 15 addresses Sinusoid Table 16 in response to the contents of Adder Accumulator 14 and causes the value $\cos[\pi q(M-1)/W] = C_{Mq}$ to be read out of Sinusoid Table 16.

A value of N is inserted into Pulse Width Control 17 from a number selection means via line 18 for a pulse width select. Pulse Width Control 17 contains a comparator such that the select signal S has a zero value when M is greater than N. Pulse Width Control 17 also creates a shift signal C which has the value "0" if M is equal to 1 and C has the value "1" if M is greater than 1. N is selected to have the value N=10 to illustrate the operation of System 10 of FIG. 1.

Table 1 illustrates data signals that appear at various points of System 10 shown in FIG. 1. Table 1 is intended to serve as an aid to illustrating operation of System 10.

TABLE 1

| t | q | M | qM | CA | C | S | HSRC |
|---|---|---|---|---|---|---|---|
| 1 | 1 | 1 | 1 1 | $C_1$ | 0 | 1 | $C_1$ |
| 2 | 2 | 1 | 2 1 | $C_2$ | 0 | 1 | $C_2$ |
| ... | ... | ... | .... | ... | ... | ... | ... |
| 32 | 32 | 1 | 32 1 | $C_{32}$ | 0 | 1 | $C_{32}$ |
| 33 | 1 | 2 | 1 2 | $C_2$ | 1 | 1 | $C_1+2C_2$ |
| ... | ... | ... | ..... | ... | ... | ... | ... |
| 64 | 32 | 2 | 32 2 | $C_{64}$ | 1 | 1 | $C_{32}+2C_{64}$ |
| 65 | 1 | 3 | 1 3 | $C_3$ | 1 | 1 | $C_1+2C_2+2C_3$ |
| ... | ... | ... | ..... | ... | ... | ... | ... |
| 289 | 1 | 10 | 1 10 | C | 1 | 1 | $C_1+2C_2+\ldots+2C_{10}$ |
| ... | ... | ... | ..... | ... | ... | ... | ... |
| 320 | 32 | 10 | 32 10 | $C_{320}$ | 1 | 1 | $C_{32}+2C_{64}+\ldots+2C_{320}$ |
| 321 | 1 | 11 | 1 11 | $C_{11}$ | 1 | 0 | (No Change) |

where
t: bit time in coefficient computation cycle
q: harmonic number; content of Harmonic Counter 12
M: content of Word Counter 13
qM: content of Adder-Accumulator 14
CA: number addressed from Sinusoid Table 16
C: left shift control signal
S: Gate control signal
$C_{Mq} = \cos[\pi q(M-1)/W]$ At time $t=t_1$; ($t=1$), S is "1" because M=1 is less than the cut-off value N=10. Therefore Gate 19 is not inhibited so that the value $C_1$ is transferred via Gate 19 from Sinusoid Table 16 to Left Shift 20. The net result is that, at time $t_1$, a value $C_1$ is added by means of Adder 22 to the data word addressed out from Harmonic Shift Register 21. The contents of Harmonic Counter 12 are used to address words out of Harmonic Shift Register 21.

Harmonic Shift Register 21 is a set of read-write registers which advantageously may comprise an end-around shift register. The contents of Harmonic Shift Register 21 are initialized to a zero value at the start of a coefficient evaluation cycle.

At time $t_2$; $q=2$, M=1, C=0 and S=1. Therefore as described above a value $C_2$ is placed in the Harmonic Shift Register 21 for an address corresponding to the harmonic number $q=2$.

The first subroutine of the coefficient computation cycle is iterated for 32 bit times. At the end of the first subroutine, the contents of Harmonic Shift Register 21 are the first 32 values indicated in Table 1 under the column heading HSRC(Harmonic Shift Register Content).

Time $t_{33}$ initiates the second subroutine of the computation cycle. At time $t_{33}$, Harmonic Counter 12 returns to its initial value of one because this is counter modulo W, and W has been selected to have the value 32. The recycling of Harmonic Counter 12 creates a Reset signal which increments the contents of Word Counter 13 to the value $M=2$. The Reset signal also causes the contents of Adder-Accumulator 14 to be initialized to a zero value.

For the second subroutine of the coefficient computation cycle, $q$ is successively incremented through its range of 32 values while the contents of Word Counter 13 are maintained at the value $M=2$. During the second subroutine of the coefficient computation cycle C has the value "1". Thus each value of the data words addressed from the Sinusoid Table 16 and transferred to Left Shift 20 via Gate 19 are doubled in value by Left Shift 20. These doubled data values are successively added to the contents of Harmonic Shift Register 21 according to the associated harmonic number $q$ received from Harmonic Counter 12.

At time $t_{33}$, the contents of the first word, $q=1$, is $C_1+2C_2$ as indicated in Table 1. At time $t_{64}$, the contents of the data word position corresponding to $q=32$, is $C_{32}+2C_{64}$.

At time $t_{65}$, the third subroutine of the coefficient computation cycle is initiated. The third subroutine is essentially the same as that described above for the second subroutine. Table 1 indicates the contents of Harmonic Shift Register 21 and the various control parameters.

Similar action, as indicated in Table 1, continues through the 10th subroutine of the coefficient computation cycle. At time $t_{321}$, an eleventh subroutine is initiated. However, since now M is greater than $N=10$, the value of S is "0" and Gate 19 inhibits the transfer of any further data which may be read out of Sinusoid Table 16. The value of $S=0$ is maintained until a new coefficient computation cycle is initiated by Executive Control 11.

Figure 3:
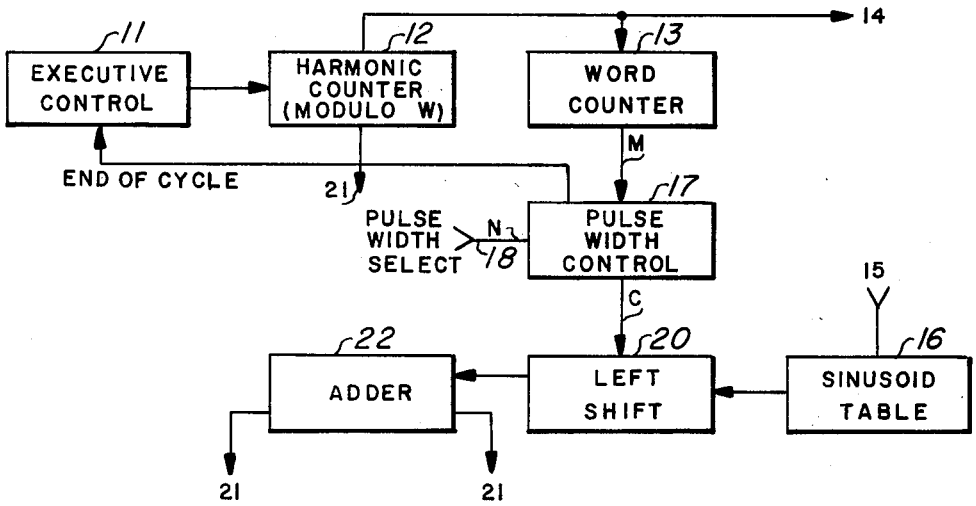
FIG. 3 is a partial block diagram of alternative circuitry for terminating a harmonic coefficient computation cycle.

FIG. 3 illustrates an alternative implementation of System 10 shown in FIG. 1. In the modification shown in FIG. 3, Gate 19 of FIG. 1 is eliminated. Pulse Width Control 17, as implemented in FIG. 3, creates an End of Cycle signal when its internal comparator indicates that a value of M transmitted from Word Counter 13 is greater than the value of N inserted from the Pulse Width Select via line 18. The end of Cycle signal occurs when $S=0$ signifying that M is greater than N. The End Of Cycle signal is transmitted via line 23 to Executive Control 11. When the signal is received, Executive Control 11 terminates the coefficient computation cycle.

At the end of a coefficient computation cycle, the contents of Harmonic Shift Register 21 are the values $d_q$ shown in Equation 1.

Adder-Accumulator 14 advantageously accumulates the data received from Word Counter 13 in a register having a data capacity of 64 and such that it is modulo 64. With this selection of a modulo 64 register, Sinusoid Table 16 can be implemented with 64 data points. These 64 data points are equally spaced for a cosine function having 64 points per cycle. Thus each point corresponds to an angle of $360/64=5.625°$.

Advantageously Left Shift 20 may be a binary logic device which either transfers binary data input with no change between its input and output terminals, or, in response to the shift signal C having a "1" value, performs a one bit left shift of the input data before transferring the signal to the output terminal. A one bit left shift of a binary data word is equivalent to a multiplication of the data value by a factor of 2.

Shift Signal C has the value "1" when M is equal to 1 and C has the value "0" for all other values of M. Shift Signal C is generated by means of the NOR gate 24 and AND gate 25 shown in FIG. 4. All the bits of M contained in Word Counter 13, except for the LSB (least significant bit) $M_6$, are connected to NOR gate 24. The output of NOR gate 24 is "1" if bits $M_1$ through $M_5$ are all "0". Therefore, the output of AND gate 25 is "1" if the LSB $M_6$ is "1" and all the other bits comprising M are "0". The output of AND gate 25 is the Shift Signal C.

Figure 4:
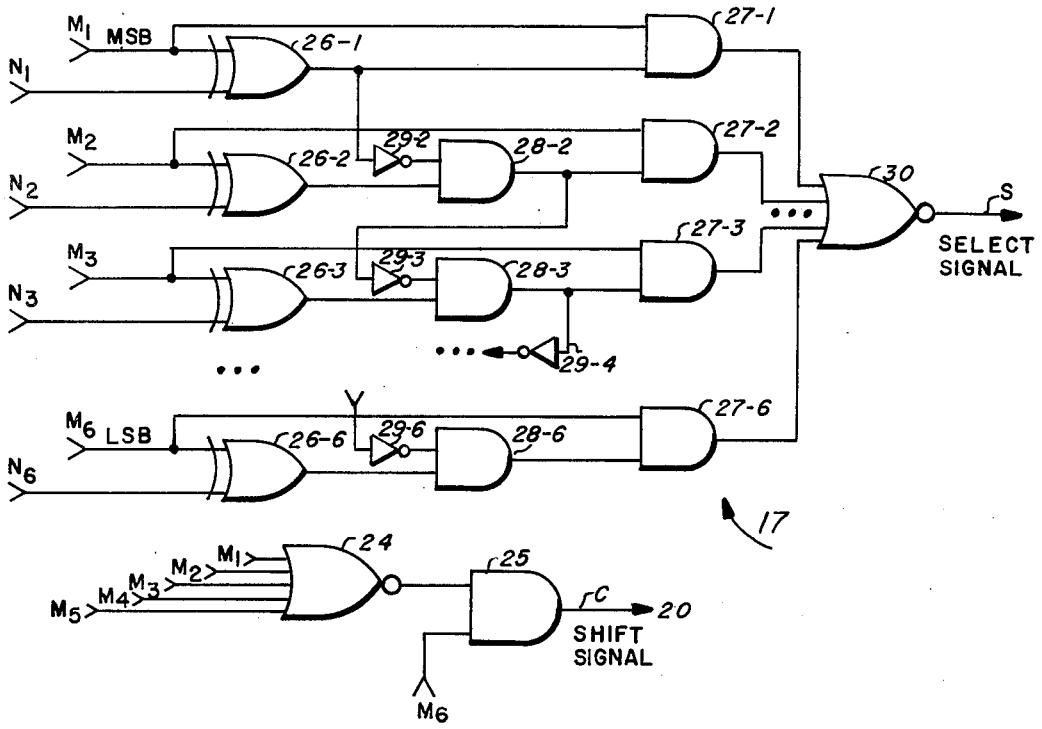
FIG. 4 is a logic diagram of the Pulse Width Control.

The logic shown in the upper portion of FIG. 4 is an implementation of a comparator which generates the Select Signal S for values of M greater than the pulse width control number N.

The output of EXOR gate 26-1 is a "1" if the MSB of M and N differ. That is, a "1" is created if $M_1$ is not equal to $N_1$. The output of AND gate 27-1 is a "1" if $M_1=1$ and $N_1=0$ ($M_1$ is not equal to $N_1$). Thus if $M_1=1$ and $N_1=0$, the NOR gate 30 creates a "0" signal for Select Signal S signifying that M is greater than the pulse width number N.

If $M_1=N_1$, then the "0" signal created by EXOR gate 26-1 is transformed to a "1" signal by invertor 29-2 to become an input to AND gate 28-2. The second input to AND gate 28-2 is a "1" if $M_2$ is not equal to $N_2$. Therefore, the output of AND gate 28-2 is a "1" if $M_1=N_1$ and $M_2$ is not equal to $N_2$. The output of AND gate 27-2 is a "1" if the output of AND gate 28-2 is a "1" and if $M_2$ is a "1". The net result is that NOR gate 30 also creates a "0" if $M_1=N_1$, $M_2=1$ and $N_2=0$.

The remainder of the logic gates operate in a similar manner by comparing the lower significant bits in a manner described above for the first two significant bits of M and N. The select signal S can be used as the End of Cycle Signal shown in FIG. 3.

The Sinusoid Table 16 may comprise a read only memory storing values of $\cos(\pi\phi/W)$ for $0\leqq\phi\leqq 2W$ at intervals of L, where L is called the resolution constant of the memory. L is related to the maximum number of harmonics W such that $L=360/2W$. For the illustrative example used to describe the operation of System 10 in FIG. 1, $W=32$ so that the resolution constant $L=5.625$. As described below, System 10 may be imbedded as a subsystem of a musical tone generator so that common system blocks can be time shared. For these applications L may be advantageously chosen to be a smaller number than 360/2W. In such instance, Memory Address Decoder 15 may round off the value it receives from Adder Accumulator 14 so as to access from the Sinusoid Table 16 the closest stored cosine value corresponding to Equation 1. Alternatively, Memory Address Decoder 15 may access the next lowest cosine value address, or the next higher such value. For organ tone systems, a Sinusoid Table having 256 entries is a satisfactory design choice and corresponds to a resolution constant L=360/256=1.40625 degrees.

The cosine values stored in Sinusoid Table 16 may have the nominal values ranging from +1 to −1. An alternative is to multiply each cosine value by a preselected constant before they are stored. The value of the constant is chosen to scale (multiply) the values of $d_q$ as computed according to Equation 1. Another modification is to use a multiplier so that the data read out from Sinusoid Table 1 can be multiplied by preselected fixed constants or even by factors that can vary with time in a predetermined manner.

The value of the pulse width parameter N can be selected by various means. For manual control, N can be selected by the musician from an instrument console control. When System 10 is used in conjunction with a tone synthesizer, the value of N can readily be made to vary as a function of the envelope of a musical tone. Another commonly used tonal effect is to make N increase, or decrease, as a predetermined function of time and to initiate the change in the value of N with the start of a musical note.

Figure 5:
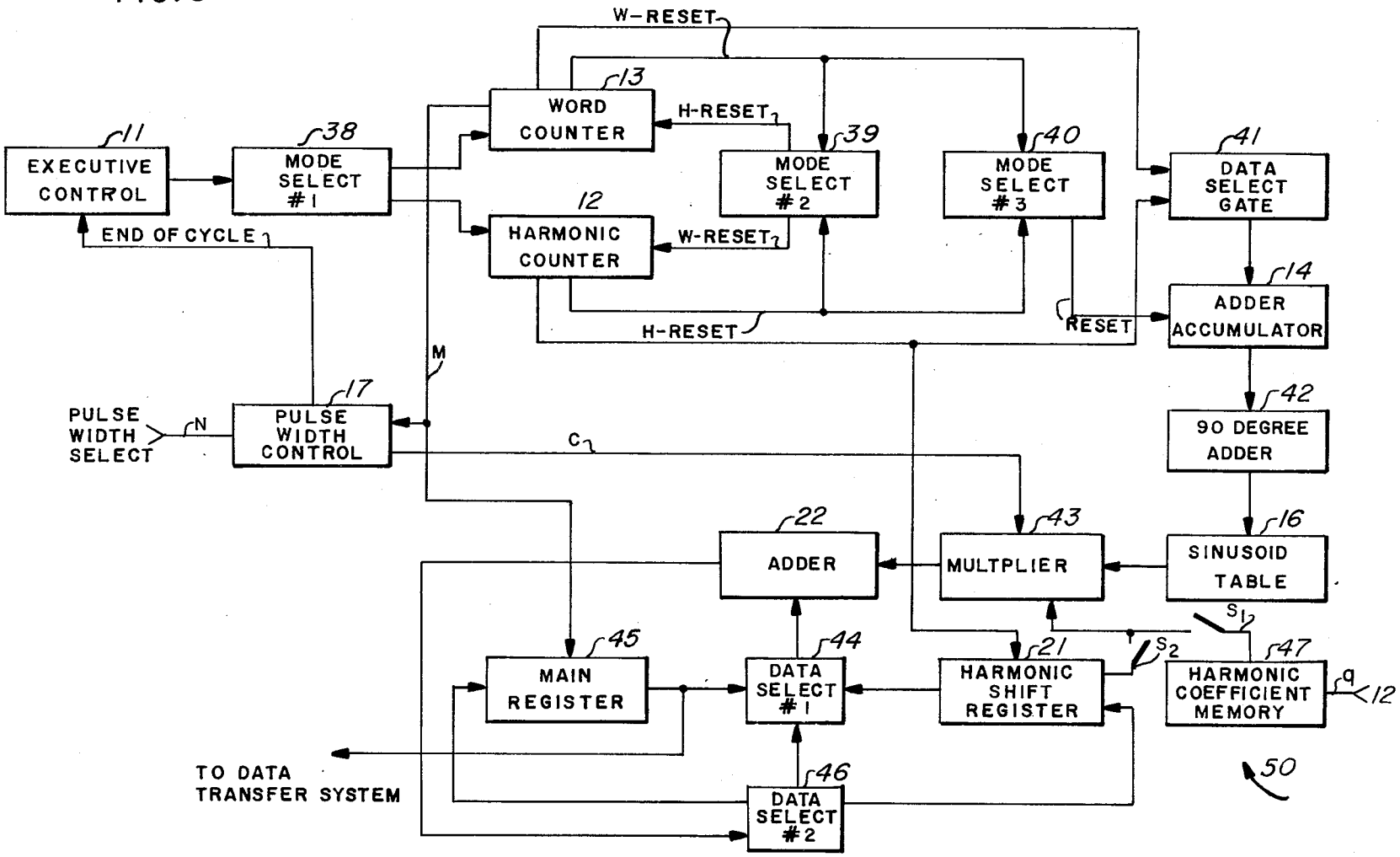
FIG. 5 illustrates the combination of the harmonic coefficient generator with the Polyphonic Tone Synthesizer.

FIG. 5 shows a means whereby the present invention can be advantageously combined with the Polyphonic Tone Synthesizer in the above-mentioned U.S. patent application Ser. No. 603,776 and herein incorporated by reference. The Polyphonic Tone Synthesizer operation comprises a data computation cycle and a data transfer cycle. The data transfer cycle for the combined System 50 shown in FIG. 5 is the same as that described in the above referenced patent application.

The data computation cycle comprises two major cycles. The first major cycle is called the master cycle and the second major cycle is called the coefficient cycle. During the master cycle a master data set is calculated according to the relation $$Z(M) = \sum_{q=1}^{W} c_q \sin(\pi M q/W) \qquad \text{(Equation 2)}$$

where M=1,2, . . . ,2W is the number of a master data set word, $q$=1,2, . . . ,W is the harmonic number, W=M/2 is the number of harmonics used to synthesize the master data set, and $c_q$ are the harmonic coefficients. $q$ is sometimes called the order of the harmonic component, the harmonic order number or simply the harmonic number. Each term in the summation shown in Equation 2 is called a Fourier component, or a constituent Fourier component, as the terms are constituent elements of the number $z$(M). The constituent Fourier components are indexed by the number $q$ which is sometimes also called the order of the associated Fourier components or simply called the order number. At the end of a master cycle, the master data set comprising data words corresponding to the values of Z(M) defined in Equation 2 are stored in Main Register 45.

At the end of a master cycle, the master data set is transferred in a fashion described in the above referenced patent application (603,776), to the subsystem that transforms the master data set to musical waveforms.

The timing and system logic control function are contained in Executive Control 11. At the start of a master cycle, Executive Control 11 initializes several system logic blocks: Word Counter 13 is set to the value one; Harmonic Counter 12 is set to the value one; Adder-Accumulator 14 is set to zero; all words in Main Register 45 are set to zero.

During a master cycle, Executive Control 11 causes Mode Select #1 38, Mode Select #2 39, Mode Select #3 40, Data Select #1 44, and Data Select #2 46 to be switched to selection states that are maintained during the entire master cycle.

Mode Select #1 38 causes the timing clock pulses created by Executive Logic 11 to be directed to Word Counter 13 so that during the master cycle, the contents M of Word Counter 13 are incremented by Executive Logic 13. Word Counter 13 comprises a modulo counter. For purposes of illustration, Word Counter 13 is selected as modulo 2W.

At the clock time for which Word Counter 13 is reset, a W-Reset signal is created and is transferred via Mode Select #2 39 to Harmonic Counter 12. Harmonic Counter 12 is incremented each time a W-Reset signal is received. The content of Harmonic Counter 12 is the harmonic number q.

The W-Reset signal is transferred via Mode Select #3 40 to appear as a Reset signal at an input to Adder-Accumulator 14. When a Reset signal is received, the content of Adder-Accumulator 14 is set at a zero value.

During a master cycle, 90-Degree Adder 42 transfers the content of Adder-Accumulator 14 to Sinusoid Table 16 with no change.

If switch $S_1$ is closed and switch $S_2$ is opened, then harmonic coefficients $c_q$ are addressed out of Harmonic Coefficient Memory 47 in response to the harmonic number $q$ which is the content of Harmonic Counter 12. The harmonic coefficient $c_q$ is multiplied by Multiplier 43 with the sinusoid value addressed out of Sinusoid Table 16.

Data Select #1 44, during a master cycle, causes the data words read out of Main Register 45 to be transferred as one input to Adder 22 while inhibiting the data read out of Harmonic Shift Register 21. The data read out of Main Register 45 is thus added to the data output from Multiplier 43. Data Select #2 46 causes the summed data produced by Adder 22 to be transferred to Main Register 45. This transferred data is caused to be stored in Main Register 45.

The master cycle comprises NW timing pulses for each set of harmonic coefficients $c_q$ used to create a master data set.

The coefficient cycle is used to create a set of coefficients $d_q$ calculated according to Equation 1. At the end of the coefficient cycle, the coefficients $d_q$ are stored in Harmonic Shift Register 21. If switch $S_2$ is closed, the coefficient set of $d_q$ can be used in combination with the coefficient set $c_q$ to generate a master data set during a subsequent master cycle.

For a coefficient cycle, the various Mode Select and Data Select logic blocks are set so that System 50 of FIG. 1 operates in a manner similar to that described above for the system shown in FIG. 3. Mode Select #1 38, causes the timing pulses from Executive Control 11 to increment Harmonic Counter 12. Harmonic Counter 12 is a counter modulo W. When the contents are incremented to the value W, the counter is reset and an H-Reset signal is generated. Mode Select #2 39 transfers the H-Reset signal to increment the content M of Word Counter 13. Mode Select #3 40 causes the H-Reset signal to appear as the Reset signal at the input to Adder-Accumulator 14.

90-Degree Adder 42 adds a fixed value of 16 to the data transferred from Adder-Accumulator 14. Because Sinusoid Table 16 has 64 data points per period, the addition of 64/4 to the address causes the output data to correspond to the cosine of the address rather than to the sine values used during a master cycle.

Multiplier 43 acts in its usual manner for the value $q=1$. For all other values of $q$ greater than one, Multiplier 43 causes a one bit left shift of its output product during a coefficient cycle.

Data Select #1 44 selects the output data from Harmonic Shift Register 21 and Data Select #2 46 causes the output data from Adder 22 to be transferred and caused to be stored in Harmonic Shift Register 21.

Figure 6:
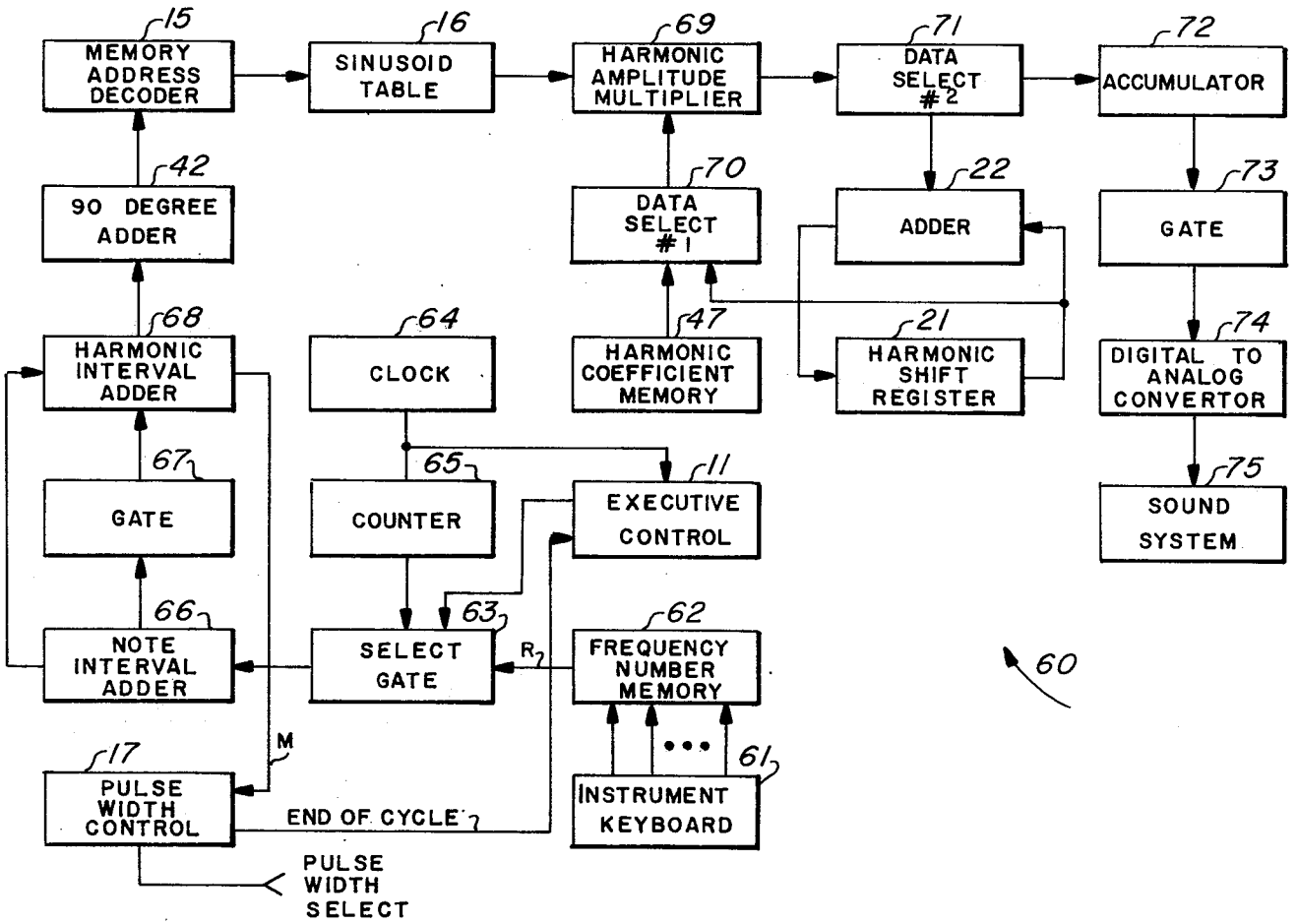
FIG. 6 illustrates the combination of the harmonic coefficient generator with the Computor Organ.

FIG. 6 shows a means whereby the present invention can be advantageously combined with a musical tone generator similar to the Computor Organ which is described in U.S. Pat. No. 3,809,786. When the pulse width modulation of the present invention is combined with the Computor Organ, Executive Control 11 causes a time sharing of time slots between the tone generating computations with time slots designated for the computation of harmonic coefficients $d_q$ associated with the pulse width modulation and which are computed according to Equation 1.

The operation of FIG. 6 is described below for those coefficient time slots generated by Executive Control 11 during which the coefficients $d_q$ are computed. During a coefficient time slot, Select Gate 63 causes clock pulses to increment Note Interval Adder 66. The contents of Note Interval Adder are the harmonic number $q$. Note Interval Adder 66 is caused to be a counter module W during the coefficient time slots. The reset signal generated when Note Interval Adder 66 is reset, because of its modulo action, is transmitted via Gate 67 to increment the contents of Harmonic Interval Adder 68. The contents of Harmonic Interval Adder are the values of M described in the operation of Word Counter 13 of FIG. 3.

90-Degree Adder 42 operates analogous to that described above for System 50 of FIG. 5.

Harmonic Amplitude Multiplier 69 functions in the manner previously described for Multiplier 43 shown in FIG. 5.

During the coefficient time slots Data Select #2 71 causes the output data from Harmonic Amplitude Multiplier 69 to be transferred to the input of Adder 22. During the other time slots, Data Select #2 71 transfers the data from Harmonic Amplitude Multiplier 69 to Accumulator 72. Moreover, Data Select #1 70 causes a selection of the harmonic coefficients residing in Harmonic Coefficient Memory 47 and those residing in Harmonic Shift Register 21.

The extension of System 60 of FIG. 6 to polyphonic tone generators of the Computor Organ type is readily made. Instead of dedicating special time slots for the coefficient time slots, the coefficient time slots can be shared with a time slot normally dedicated to a member of the polyphonic tone generators. For example, tone generator 12 can be used advantageously if this represents the last tone generator to be assigned in a set of 12 tone generators. Since, for many instances, the number 12 generator is seldom assigned, its time slot can be used to generate the pulse width coefficients $d_q$ without any loss in musical system capability.

Figure 7:
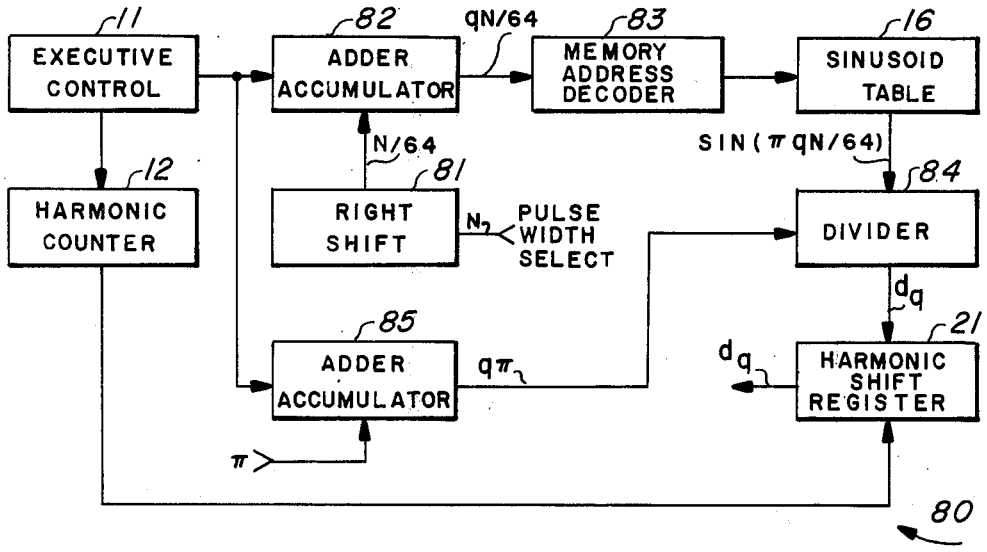
FIG. 7 is a block diagram of an alternate system for generating harmonic coefficients corresponding to pulse width modulation effects.

System 80 shown in FIG. 7 is an alternative system for obtaining the set of Fourier harmonic coefficients corresponding to pulse width modulation. System 80 operates to evaluate the harmonic coefficients according to the relation $$d_q = \frac{N}{2W} \cdot \sin(\pi qN/2W) \,/\, (\pi qN/2W). \qquad \text{(Equation 3)}$$

This relation can be placed in the following form which facilitates the explanation of the operation of System 80:

$$d_q = \left(\frac{1}{q\pi}\right) \cdot \sin(\pi qN/2W). \qquad \text{(Equation 4)}$$

It is advantageous to select W as a power of 2. For illustration purposes, W is chosen as W=32, although this choice in no way is a limitation of the present invention.

In FIG. 7, Executive Control 11 initiates all the timing and logic control functions. At the start of a computation cycle, Executive Control 11 causes the contents of Adder-Accumulator 82 and Accumulator 85 to be initialized to zero value. A value of the pulse width parameter N is selected and inserted into Right Shift 81. Right Shift 81 performs a right shift of the input data N of six bit positions thereby producing the value of N/64 as an input data signal to Adder-Accumulator 82. The denominator term 64 corresponds to the illustrative value of W=32 in Equation 3.

At each time signal received from Executive Control 11 during a computation cycle, Adder-Accumulator 82 receives the current value of N/64 and adds it to an accumulated sum. Each such time signal corresponds to successive values of the harmonic number $q$. Hence, the contents of Adder-Accumulator 82 is the value $q$N/64.

Memory Address Decoder 83 receives the value $q$N/64 from Adder-Accumulator 82 and decodes the value to address the data $\sin(\pi\, q\mathrm{N}/64)$ from Sinusoid Table 16.

The value $\pi=3.14159$ is an input to Adder-Accumulator 85. At each time signal received from Executive Control 11, Accumulator 85 adds the value of $\pi$ to its current accumulated sum. The net result is that the contents of Adder-Accumulator 85 is the value $q\pi$ which is the first factor on the right side of Equation 4.

Divider 84 receives the accumulated value of $q\pi$ from Adder-Accumulator 85 and uses this value to divide the data $\sin(\pi\, q\mathrm{N}/64)$ address out from Sinusoid Table 16.

The time signals created by Executive Control 11 during a computation cycle are used to increment the contents of Harmonic Counter 12. The content of Harmonic Counter 12 is the harmonic number $q$. The harmonic number $q$ obtained from Harmonic Counter 12 is used to control the write address of Harmonic Shift Register 21 so that the harmonic coefficient $d_q$ from Divider 84 is written into a memory position associated with the corresponding harmonic number $q$.

The harmonic coefficients generated and stored in Harmonic Shift Register 21 can be advantageously used as described above for a variety of tone generators including the Polyphonic Tone Synthesizer (U.S. patent application Ser. No. 603,776) and the Computor Organ (U.S. Pat. No. 3,809,786).

It is apparent that the various systems described above are equally applicable when the sinusoid table is replaced by a table of generalized harmonic functions. The term generalized harmonic functions is used in the generic sense in the claims to include functions such as the Walsh, Bessel, and trigonometric functions as well as to include orthogonal polynomials such as Legendre, Gegenbaur, Jacobi, and Hermite Polynomials. When orthogonal functions other than the trigonometric functions are used, the resulting harmonic coefficients will not generally correspond to those for a rectangular pulse. However, they are very useful for a musical instrument because the harmonic coefficients can be readily made to be time dependent upon a single input pulse shape parameter N.

It is well-known in mathematical art that for a period of a waveshape, such as a rectangular repetitive pulse, a generalized harmonic series can be used to represent the waveshape. Such generalized harmonic series include but are not limited to a Fourier series of the type shown in Equation 1. The generalized harmonic series corresponding to Equation 1 is written in the form $$d_q = \sum_M a_M \phi_q(M) \qquad \text{(Equation 5)}$$

where $M=1,2,\ldots,N$ and the harmonic number $q$ has the range of values $q=1,2,\ldots,W$. W is the total number of the generalized Fourier harmonic coefficients $d_q$ and where $\phi_q(M)$ denotes any of the various members of the family of orthogonal functions or orthogonal polynomials. By analogy with conventional Fourier series, the coefficients $a_M$ are called generalized Fourier harmonic coefficients. Frequently Equation 5 is called a discrete generalized Fourier transform. The individual terms in the summation are called constituent generalized Fourier components of $d_q$. The index $q$ is sometimes called by such terms as the order of the generalized Fourier harmonic coefficients, the harmonic order number, or simply the harmonic number. The orthogonal functions, or orthogonal polynomials, by analogy are often called the generalized harmonic functions because of their formal identification with the trigonometric harmonic functions of the ordinary Fourier analysis.

It is apparent that the various subsystems already described in combination with System 10 as shown in FIG. 1 are equally applicable to System 10 wherein the sinusoid table is replaced by a table of generalized harmonic functions containing values of any particular selection of a member of the family of orthogonal functions. The memory address decoder 15 of FIG. 1 is used to access values of the selected orthogonal functions or orthogonal polynomials $\phi_q(M)$ from this orthogonal function table in a manner analogous to that of accessing trigonometric values from a sinusoid table.

While a digital mechnaization has been described, this is not necessary. All the system functions could be carried out in an equivalent analog form.

Intending to claim all novel, useful and unobvious features shown or described, the applicant makes the following claims:

1. In a waveshape generating system of the type wherein waveshapes are generated by calculating the constituent Fourier components of a waveshape according to a discrete Fourier algorithm and wherein each said Fourier component comprises the product of a trigonometric function and a harmonic coefficient, the improvement for generating a waveshape having the spectral quality of a repetitive pulse train of selectable pulse width comprising;

a control means for selecting a member N of a set of control parameters each control parameter being associated with a pulse width of said repetitive pulse train, and a coefficient generating means, operative during a coefficient computation cycle and responsive to said selected member of said set of control parameters, for providing said harmonic coefficients to said waveshape generating system thereby causing a corresponding waveshape to be generated having the spectral quality of a repetitive pulse train, where said coefficient generating means comprises: a clock generator means wherein timing signals are generated, each said timing signal in said coefficient computation cycle corresponds to a harmonic number $q$, a select means for choosing a member N from a set of pulse width parameters, a width factor means whereby said chosen member N of set of pulse width parameters is scaled by a selected scale factor H to produce a pulse width value N/H, and an address-accumulator means, initialized at the start of said coefficient computation cycle and operative during each computation time interval corresponding to said timing signals for repeatedly adding said pulse width value N/H to sum previously in said adder-accumulator means, whereby the resulting contents of said adder-accumulator means is the argument number $q$ N/H.

2. A wave shape generating system according to claim 1 wherein said coefficient generating means further comprises;

a sinusoid table comprising a memory storing values of $\sin(\pi\theta/H)$ for $0 \leqq \theta \leqq H$ at intervals of L where L is a resolution constant, a memory accessing means for accessing values from said sinusoid table corresponding to said argument number $q$N/H, a second adder-accumulator means, initialized at the start of said coefficient computation cycle, and operative during each computation time interval corresponding to said timing signals for repeatedly adding the number $\pi=3.14159$ to the sum previously in said second adder-accumulator means, whereby the resulting sum in said second adder-accumulator means is the number $q\pi$, and a divider means whereby said values accessed by said memory accessing means are divided by said number $q\pi$ contained in said second adder-accumulator means.

3. A wave shape generating system according to claim 2 further comprising utilization means whereby numbers obtained by division in said divider means are used to calculate Fourier components.

4. A wave shape generating system according to claim 3 wherein said utilization means further comprises means for generating musical wave shapes.

5. In a wave shape generating system of the type wherein waveshapes are generated by calculating the constituent generalized Fourier components of a waveshape and wherein each constituent generalized Fourier component is determined by an associated generalized Fourier harmonic coefficient $d_q$, the improvement for generating a waveshape having the spectral quality of a repetitive pulse train of selectable pulse width comprising;

a control means for selecting a member N of a set of control parameters each control parameter N being associated with a pulse width of said repetitive pulse train, and a coefficient generating means, operative during a coefficient computation cycle and responsive to said selected member N of said set of control parameters, for providing said generalized Fourier harmonic coefficients $d_q$ to said waveshape generating system thereby causing a corresponding waveshape to be generated having the spectral quality of a repetitive pulse train, where said coefficient generating means includes: a first memory means for writing said generalized Fourier harmonic coefficients to be thereafter read out, wherein number $q$ designates address of words in said first memory means; a first means for computing said generalized Fourier harmonic coefficients $d_q$ in accordance with the relation for a discrete generalized Fourier transform $$d_q = \sum_{M=1}^{N} a_M \phi_M(q)$$

where $M=1,2,\ldots,N$, $q=1,2,\ldots,W$; $q$ is the harmonic number; W is the total number of said generalized Fourier harmonic coefficients; said first means comprising a function table comprising a memory storing values of the function $\phi_M(q)$ and a generalized harmonic component evaluation circuitry utilizing said function table to calculate $a_M\phi_M(q)$ for each of the W generalized Fourier harmonic coefficients $d_q$ in response to a selected value of $q$, and a means for writing said generalized Fourier harmonic coefficients into said first memory means.

6. In a waveshape generating system according to claim 5 wherein said generalized harmonic component evaluation circuitry further comprising;

a harmonic counter means incremented at each computation time in said coefficient computation cycle wherein said harmonic counter counts modulo W, the contents of harmonic counter thereby represents said harmonic number $q$, modulo reset circuitry whereby a reset signal is created when said harmonic counter means is reset at its maximum count, a word counter means incremented by said reset signal wherein said word counter is caused to count said reset signals during said coefficient computation cycle, thereby the contents of said word counter is said number M, an adder-accumulator means for adding successive values of said number M contained in said word counter means wherein said adder-accumulator means is initialized to zero by said reset signal, thereby the resulting content of said adder-accumulator means represents an argument of said function $\phi_M(q)$, and means for obtaining values of said function $\phi_M(q)$ in response to contents of said adder-accumulator means, and a means for successively algebraically summing output from said means for obtaining values with contents of word $q$ in said first memory means.

7. In a waveshape generating system according to claim 6 wherein said control means comprises:

select means for selecting a member of said set of control parameters, and width control means responsive to said selected member of said set of control parameters and to content M of said word counter means, wherein a shift signal is created with the value "zero" if said number M is equal to one and is created with the value "one" if said number M is not equal to one, and wherein a select signal is created if said value M is greater than said selected member of said set of control parameters.

8. In a wave shape generating system according to claim 7 wherein said first means for computing further comprises;

a function table comprising a memory storing values of the function $\phi_M(q)$ which are the trigonometric functions $\cos(\pi\theta/W)$ for $0 \leqq \theta \leqq 2W$ at intervals of L where L is a resolution constant, a scaling means responsive to said shift signal wherein if shift signal has the value "zero" said values of $\cos(\pi\theta/W)$ accessed from said function table are divided by two and provided to said means for successively algebraically summing, and wherein if said shift signal does not have value "zero" said values of $\cos(\pi\theta/W)$ accessed from said function table are provided unaltered to said means for successively algebraically summing, and termination means responsive to said select signal wherein if said select signal is created said values of $\cos(\pi\theta/W)$ accessed from said function table are inhibited and not provided to said means for successively algebraically summing.

9. In a waveshape generating system according to claim 8 wherein said termination means further comprises termination circuitry wherein in response to said select signal said coefficient computation cycle is caused to terminate.

10. In an electronic musical instrument of the type wherein musical tones are generated by calculating the constituent generalized Fourier components of a musical waveshape and wherein each constituent Fourier component is determined by a generalized Fourier harmonic coefficient, the improvement for generating musical tones having the tonal quality of a repetitive pulse train of selectable pulse width comprising;

a harmonic counter means incremented at each computation time in a coefficient computation cycle wherein contents of said harmonic counter means is a harmonic number $q$ and wherein harmonic counter counts modulo W, a word counter means, responsive to said harmonic counter means, wherein contents of said word counter is an order number M, an adder-accumulator means responsive to said harmonic counter means and initialized when said value of $q$ is equal to "one" and operative during each said computation time interval wherein successive values of said number M contained in said word counter means are successively accumulatively added whereby the resulting contents of said adder-accumulator means represents the argument of a generalized orthogonal function, an orthogonal function table comprising a memory storing values of said generalized orthogonal functions $\phi_q(AL)$ at intervals of L, where L is a resolution constant, $q$ is said harmonic number and AL is said argument of said generalized orthogonal function, an orthogonal function table accessing means for accessing from said orthogonal function table the values of said generalized orthogonal function corresponding to said argument of a generalized harmonic function contained in said adder-accumulator means, select means for selecting a member of a set of pulse width control parameters each control parameter being associated with a pulse width of said repetitive pulse train, width control means responsive to said selected member of said set of control parameters and responsive to said order number M wherein a select signal is created if said order number M is greater than said selected member of said set of control parameters, a first memory means for writing input data to be thereafter read out, wherein said number $q$ designates the address of words in said first memory means, coefficient generating means responsive to said harmonic number $q$ and operative during each said computation time interval for repeatedly adding said values of said orthogonal functions accessed from said orthogonal function table by said orthogonal function table accessing means to data read from word $q$ of said first memory means and causing added values to be written in said first memory means at the word address corresponding to said harmonic number $q$, termination means responsive to said select signal whereby when said select signal is created said termination means inhibits said coefficient generating means from repeatedly adding, and utilization means whereby data written in said first memory means is used to generate said musical tones having the tonal quality of a repetitive pulse train.

* * * * *

UNITED STATES PATENT AND TRADEMARK OFFICE

CERTIFICATE OF CORRECTION

PATENT NO. : 4,116,103

DATED : Sep. 26, 1978

INVENTOR(S) : Ralph Deutsch

It is certified that error appears in the above-identified patent and that said Letters Patent are hereby corrected as shown below:

column 12, line 19 reads: address-accumulator should read: adder-accumulator

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*